US009549645B2

(12) United States Patent
Spina

(10) Patent No.: US 9,549,645 B2
(45) Date of Patent: Jan. 24, 2017

(54) SUDZ-BATH-CLOTH

(71) Applicant: Michael David Spina, Fuquay-Varina, NC (US)

(72) Inventor: Michael David Spina, Fuquay-Varina, NC (US)

( * ) Notice: Subject to any disclaimer, the term of this patent is extended or adjusted under 35 U.S.C. 154(b) by 0 days.

(21) Appl. No.: 14/545,442

(22) Filed: May 6, 2015

(65) Prior Publication Data

US 2016/0073834 A1 Mar. 17, 2016

Related U.S. Application Data

(60) Provisional application No. 62/070,950, filed on Sep. 11, 2014.

(51) Int. Cl.
*A47K 7/03* (2006.01)
*A47K 7/02* (2006.01)

(52) U.S. Cl.
CPC ..... *A47K 7/02* (2013.01)

(58) Field of Classification Search
CPC ..... A47K 7/02
See application file for complete search history.

(56) References Cited

U.S. PATENT DOCUMENTS 6,694,563 B2 * 2/2004 Onwugbonu ..... A47K 7/02 15/118

* cited by examiner

*Primary Examiner* — Shay Karls
(74) *Attorney, Agent, or Firm* — Michael D. Spina

(57) ABSTRACT

The SUDZ-BATH-CLOTH use standard length and width of two typical bath cloths, which are 10 inches to 12 inches. There are for corners that are threaded together to create a firm and long lasting hold of the two cloths materials from opening apart. The inside insert is created to purposely produce thousands of tiny bubbles.

Figure 1:
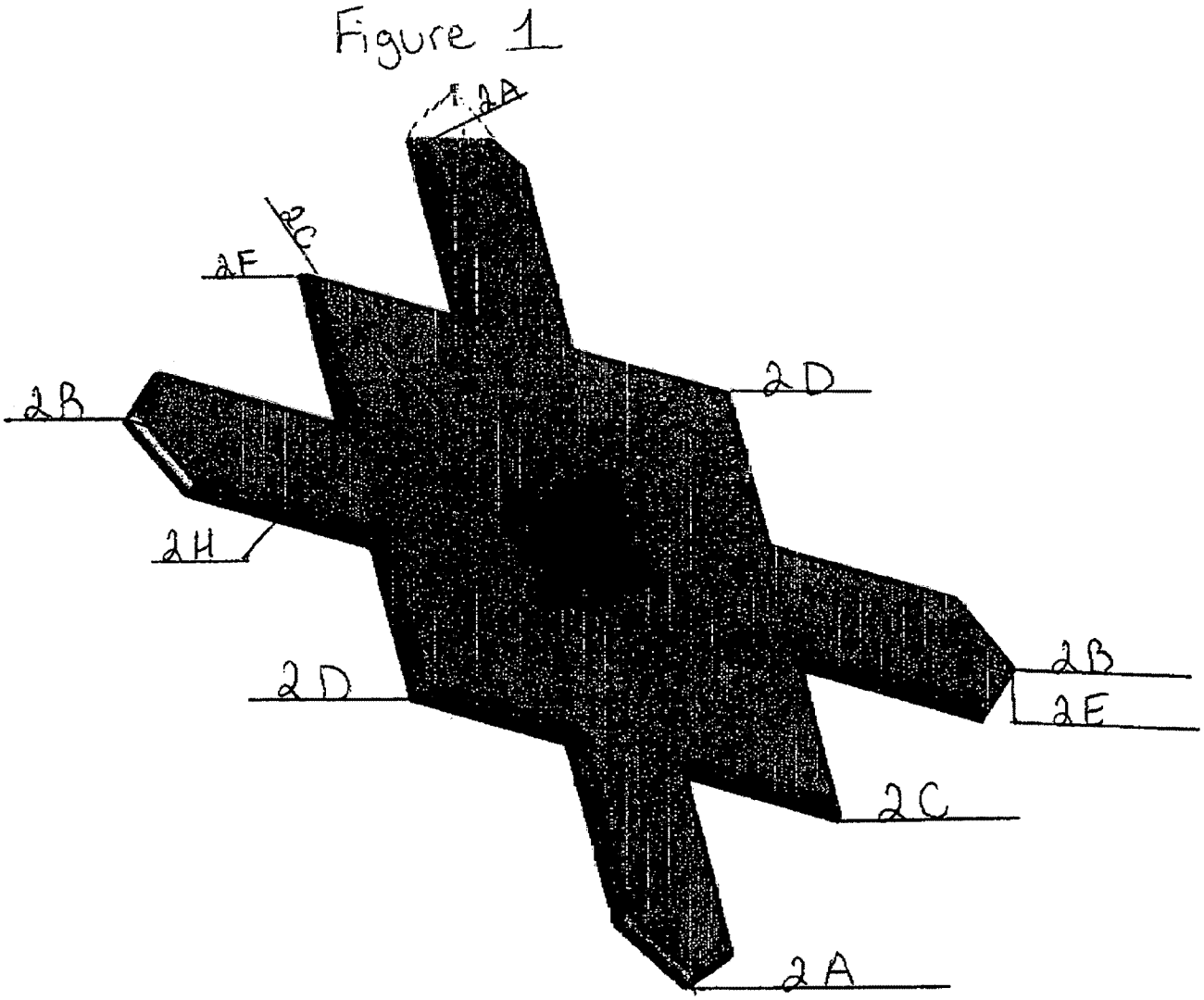

The insert has four arms that can be measured diagonally, from tip to tip, that will measure 12.5 inches. The perimeter from tip to tip as measured in say a (square) shaped object will be 8.75 inches. There are four triangle shaped designed patterns next to each arm. Two sides give a measurement of 7.50 inches tip to tip. The other two sides measured north to south, tip to tip gives a measurement of 5.5 inches. The insert is 1.0 inches thick, but can exceed with raised topping.

1 Claim, 2 Drawing Sheets

SUDZ-BATH-CLOTH

BACKGROUND OF THE INVENTION

This invention was put together one day when I was using a typical standard wash cloth. I had to repeatedly add liquid soap just to keep a good lather on my body. I was going through many bottles a week of liquid and dry bar soap. I thought about how I could make this wash cloth better or may be create a bath cloth with a new design. I came up with the Sudz-Bath-Cloth. A bath cloth that give you ample amount of lather and suds with half the amount of soap needed. I also engineered where you can wash your face with one side and then flip to use other side for your body, which will help keep other dirt or grim of your face. I also wanted to make it easy to clean to keep a smell down from the bath cloth as well, where your typical cloth can have from drying out for your next wash. The Sudz-Bath-Cloth can be squeezed several times which basically cleans the wash cloth and kills the odor from drying out. The bath cloth can also be machine washed and dried with no damage. It's the same as a towel, when you need to buy another one from old age, then buy one. I get very good results from my new bath cloth and the results are stated correctly and on point.

BRIEF SUMMARY OF INVENTION

A dual layered bath cloth for the intent use by a person to wash said person's face with one side and then flipped said wash cloth to the opposite side for the person's body, said dual layered paneled bath cloths comprising, in combination of:

A dual square design double panels that have a square measurement that consists of the dual sides of said square shaped panels; having the length approximately of all said square equal thereof;

first dual squared panel attaches to second said squared panel that is even woven attaching end to ends-point to points with polyurethane (fully reacted polymer-molecule bonds with another chemically) thereof;

a second dual squared panel attaches to first said squared panel that is woven attaching end to ends-point to points with polyurethane (fully reacted polymer-molecule bonds with another chemically) thereof;

insert of a polymer-molecular polyurethane material, that is inserted between the first dual squared panel, that is mirrored by second squared even shaped panel, then woven attaching ends to ends-point to points with elastic material shaped in an oval shape designed to hang the said claimed dual squared doubled panel in air for drying;

a first and second dual panel woven meaning to attach square end of dual shaped panels; with materials that will have long attaching abilities, such material called "nylon" upholstery being a sewing string for said dual squared designed claim;

said panels being secured, connected and attached end to squared end, with non-removable insert secured inside first and second squared shaped panels, wherein the first squared panel is securely attached to second squared panel locking insert inside; sandwiched between both squared panels;

Said panels positioned adjacent one another to form an approximately square shape for the main use to wash said person's face on first panel, therefor the second panel main purpose is for wash of the body area;

Said squared panels being constructed of a single thickness of one hundred percent material being algodon, cotton to terrycloth;

A bath cloth for use by a human-person's body and face area, said bath cloth comprising, in combination:

(a) a dual square of two washcloth panels that are attached end to end and point to points; woven heavy nylon upholstery string for secure latching; with inserted material called polyurethane, that produces hundreds of soap suds to use in combination for person's face on one panel and body area on second; that is said to be self-cleaning with easy squeezing to combustion reaction of h20 and molecules material of polyurethane-that release fizz and bubbles for purpose to clean one's body;

BRIEF DESCRIPTION OF SEVERAL VIEWS OF DRAWING

FIG. 1:

A top view of the insert of present invention.

FIG. 2:

A top view of the washcloth of the present invention

DETAILED DESCRIPTION OF THE INVENTION

This invention is a new, updated or revised invention, which will

Stand-alone against the standard bath cloth on the market today,

The Suds-Bath-Cloth is customized to be the ultimate bathing item which keeps thousands of soap suds with lather on the dual panel bath cloth The dual sided bath cloth gives you the option to wash your face area on one side and your body on the other side, with the purpose to separate germs and dirt from your face.

Sudz-Bath-Cloth is also self-cleaning, by way of repeated squeezing the bath cloth to remove the dirt or grim on the cloth.

The cloth is also allowed to be washed by way of machine and also dried by way of machine.

One dual squared layered panel that is ten to twelve inches in length. Each end of the panel has the same or equal measurement and is the same area total. The length and width will match the area of each panel.

Second dual squared layered panel. The panel is also ten to twelve inches in length and width, with same area measurements. The length and width will match the opposite side of the panel to give a same area measurement.

Material of the panel is explained to be a mixture from beginning plain to a textured top finish. The combination of this textured material being cotton-algondon, is best for the requirements need to add softness to ruggedness of said panel. A soft fell, but strong a rugged for a long lasting life span.

FIG. 1.: one dual squared layered panel is 10 to 12 inches in length with end to edge having the same measurement as opposite panel.

The second squared layered panel, is also 10 to 12 inches in length×width, with the same measurements-measuring, from end to end and point to point.

FIG. 1.: The material may be textured or plain in fell, with a cotton known as algondon. The textured material may have raised areas or flat patches on the cloth panel.

Figure 2:
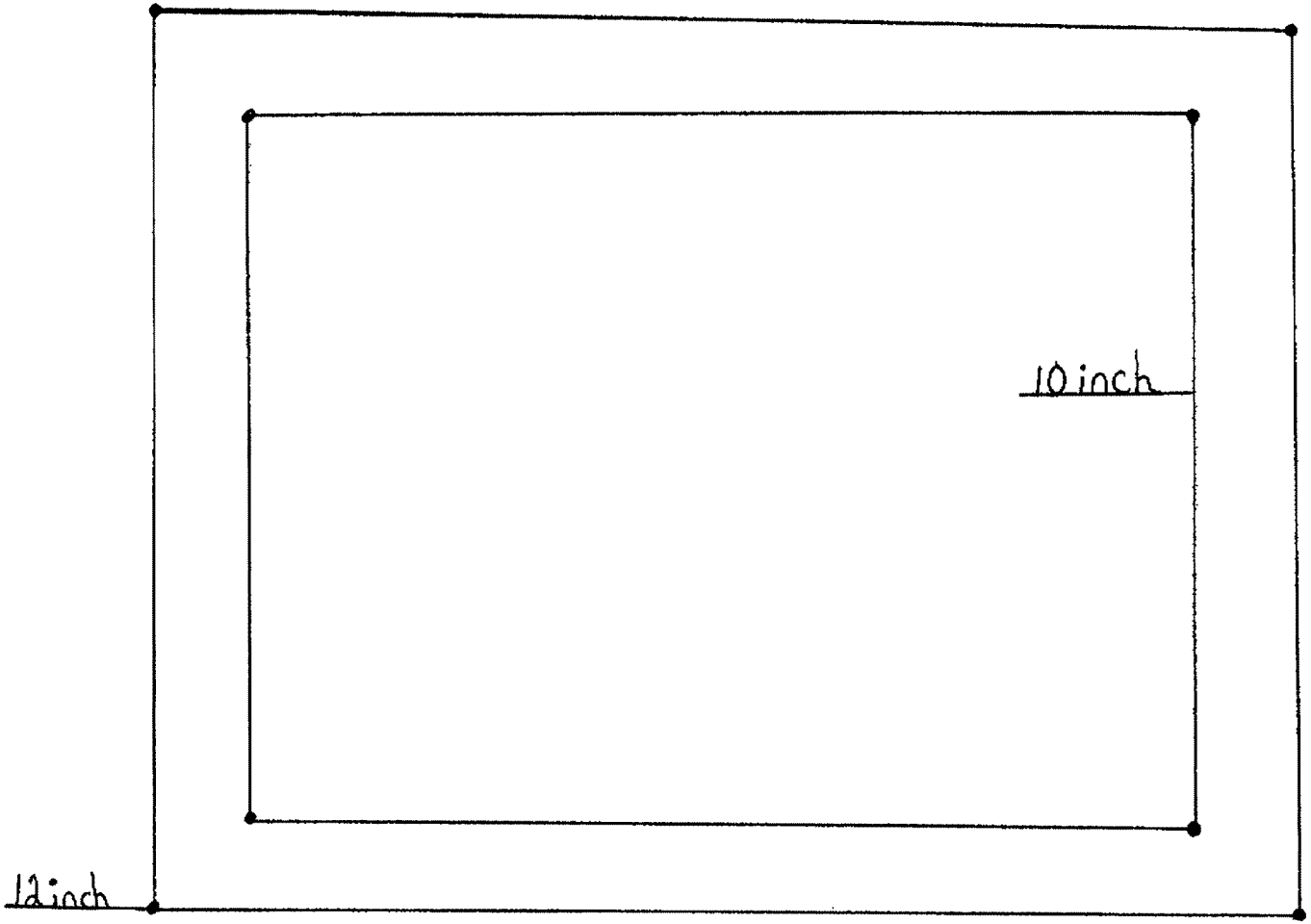

FIG. 2: The insert that is placed in between figures a dual panels, will be stabilized between both panels by the way of woven string called nylon for secure bonding and strength. The dual panels will be attached to one another by woven string called nylon to secure the insert and secure the panels from separating from one another.

The insert in clarified as a material that is fully reacted, with a polymer-molecule that bonds with another chemical element, to become the physical name known as polyurethane.

A length up to 12.5 inches (2A) diagonal measured point to point end to end;

A width of 8.75 inches (2B) from tip to tip end points as in east to east direction measure;

A width of 7.50 inches (2C) from tip to tip end to end as in a north to south direction measure;

A square area measurement of 5.5 inches (2D) in middle break down of the cubodiamontahedron, measured as square end to end in middle;

A shaped end point (2E) totaling in four, which narrow to a point for the purpose to be used in the person's eye canal areas; to remove dirt or makeup from one's face area;

A shaped end point totaling in four pyramid shaped (2F) end points, for the purpose to be used in the person's facial area; to remove heavy dirt to makeup from one's facial area;

A rippled, ridges, smooth, flat to a rough design top (2G) coating of insert named polyurethane; the said insert textured to flat helps, with a combination of pressure from person's hand, to help generate a deep powerful friction against said person's body for removal of dirt to makeup;

A fully reacted polymer-molecule that bonds with air to other chemical elements to produce suds from water, air and pressure combined by said person's hand in bathing activities;

What I now claim is:

1. A dual layer bath cloth with a first side being used to clean a person's face and a second side being used to clean a person's body, comprising, a first cloth having edges which form a square, and a second cloth having edges which form a square of the same dimensions as said first cloth, and a planar polyurethane insert with edges that form a square, wherein the insert further comprises protrusions extending outwardly, in the same plane as the insert, from the middle of each edge of the insert, said protrusion has a tapered tip; wherein, said first cloth, said insert and said second cloth are layered and sewn together to secure said insert between said cloths; wherein said sewing is along all edges of said first and second cloth and diagonally from each corner of the cloths.

* * * * *